US009740128B2

(12) United States Patent
Takemori et al.

(10) Patent No.: US 9,740,128 B2
(45) Date of Patent: Aug. 22, 2017

(54) POSITIVELY CHARGEABLE TONER FOR ELECTROSTATIC LATENT IMAGE DEVELOPMENT

(71) Applicant: KYOCERA Document Solutions Inc., Osaka (JP)

(72) Inventors: Toshiki Takemori, Osaka (JP); Yukinori Nakayama, Osaka (JP); Masaki Okita, Osaka (JP); Hiroki Uemura, Osaka (JP); Takamichi Mori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/931,349

(22) Filed: Nov. 3, 2015

(65) Prior Publication Data

US 2016/0124335 A1 May 5, 2016

(30) Foreign Application Priority Data

Nov. 5, 2014 (JP) ..... 2014-225094

(51) Int. Cl.
*G03G 9/093* (2006.01)
*G03G 9/08* (2006.01)

(52) U.S. Cl.
CPC ..... *G03G 9/09385* (2013.01); *G03G 9/0821* (2013.01)

(58) Field of Classification Search
CPC ..... G03G 9/08764; G03G 9/08766; G03G 9/09328; G03G 9/09385
See application file for complete search history.

(56) References Cited

U.S. PATENT DOCUMENTS

2005/0271964 A1 12/2005 Etou et al.
2014/0295345 A1* 10/2014 Ojima ..... G03G 9/09392 430/137.11
2014/0363761 A1* 12/2014 Liu ..... G03G 15/08 430/105

FOREIGN PATENT DOCUMENTS

JP S62-253176 A 11/1987
JP 03-160460 * 1/1991 ..... G03G 9/08
JP 2004-138985 A 5/2004
JP 2012-098386 A 5/2012

OTHER PUBLICATIONS

Translation of JP 03-160460.*
An Office Action; "Notice of Reasons for Rejection," issued by the Japanese Patent Office on Jul. 5, 2016, which corresponds to Japanese Patent Application No. 2014-225094 and is related to U.S. Appl. No. 14/931,349.

* cited by examiner

*Primary Examiner* — Peter Vajda
(74) *Attorney, Agent, or Firm* — Studebaker & Brackett PC

(57) ABSTRACT

A positively chargeable toner for electrostatic latent image development includes toner particles. The toner particles each include a toner core containing boron nitride and a shell layer disposed over a surface of the toner core. The boron nitride is contained in an amount of no less than 0.05% by mass and no greater than 35% by mass relative to total mass of the toner core. The boron nitride has a thermal conductivity of no less than 40 W/m·K and no greater than 220 W/m·K.

7 Claims, No Drawings

POSITIVELY CHARGEABLE TONER FOR ELECTROSTATIC LATENT IMAGE DEVELOPMENT

INCORPORATION BY REFERENCE

The present application claims priority under 35 U.S.C. §119 to Japanese Patent Application No. 2014-225094, filed on Nov. 5, 2014. The contents of this application are incorporated herein by reference in their entirety.

BACKGROUND

The present disclosure relates to a positively chargeable toner for electrostatic latent image development.

From a viewpoint of energy saving and apparatus miniaturization, a toner is desired to have excellent low-temperature fixability such as to be favorably fixable with minimal heating of a fixing roller. In order to produce a toner having excellent low-temperature fixability, it is common to use a binder resin having a low melting point or glass transition point, and a releasing agent having a low melting point. Therefore, when such a toner is stored at high temperatures, toner particles in the toner may aggregate. Aggregated toner particles tend to have a reduced electrostatic charge compared to other toner particles that are not aggregated.

In order to improve low-temperature fixability, high-temperature stability, and blocking resistance, a toner including toner particles each having a core-shell structure is used. In a toner particle having a core-shell structure, a toner core containing a low-melting-point binder resin is coated by a shell layer containing a resin having a higher glass transition point Tg than a glass transition point ($Tg^t$) of the binder resin contained in the toner core.

As an example of a toner including toner particles having a core-shell structure such as described above, a toner has been proposed including toner particles in which toner cores having a softening temperature of no less than 40° C. and no greater than 150° C. are each coated by a thin film containing a thermosetting resin.

SUMMARY

A positively chargeable toner for electrostatic latent image development of the present disclosure includes toner particles. The toner particles each include a toner core containing boron nitride and a shell layer disposed over a surface of the toner core. The boron nitride is contained in an amount of no less than 0.05% by mass and no greater than 35% by mass relative to total mass of the toner core. The boron nitride has a thermal conductivity of no less than 40 W/m·K and no greater than 220 W/m·K.

DETAILED DESCRIPTION

Hereinafter, an embodiment of the present disclosure will be described in detail. However, the present disclosure is not in any way limited by the following embodiment and appropriate changes may be made when practicing the present disclosure so long as such changes do not deviate from the intended scope of the present disclosure. Note that explanation is omitted where appropriate in order to avoid repetition, but such omission does not limit the scope of the present disclosure.

A positively chargeable toner for electrostatic latent image development (may be referred to simply as a toner) according to the present embodiment is a powder including a plurality of toner particles. Note that evaluation results (values indicating shape, physical properties, or the like) for a powder (for example, cores, toner mother particles, an external additive, or a toner) are number average values measured with respect to an appropriate number of particles unless otherwise stated. In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl.

The toner according to the present embodiment may be for example used in an image forming apparatus.

An image forming apparatus develops an electrostatic latent image with a developer containing a toner. Through the development, charged toner is caused to adhere to the electrostatic latent image formed on a photosensitive member. The adhered toner is transferred onto a transfer belt and is subsequently transferred from the transfer belt onto a recording medium (for example, paper). Thereafter, the toner is fixed to the recording medium by heating the toner. As a result, an image is formed on the recording medium. A full-color image can be obtained by superimposing toner images formed using different colors, such as black, yellow, magenta, and cyan.

Toner particles each include a toner core and a shell layer disposed over the surface of the toner core. The toner core contains a binder resin. The toner core may further contain as necessary an optional component in the binder resin such as a colorant, a releasing agent, a charge control agent, or a magnetic powder.

The surface of the toner particles (toner mother particles) may be treated as necessary using an external additive. Toner particles that are yet to be treated with an external additive may be referred to as toner mother particles. A plurality of shell layers may be layered on the surface of the toner core.

The toner may be used as a one-component developer or may be mixed with a desired carrier to be used as a two-component developer.

Hereinafter, components of the toner core will be described. The toner core contains boron nitride. For example, the boron nitride may be present inside of the toner core. Alternatively, the boron nitride may be absent in a center region of the toner core and present in a surface region of the toner core. The boron nitride has high thermal conductivity. The boron nitride contained in toner cores therefore improves thermal conductivity of a resulting toner, making the toner readily meltable at low temperatures.

The boron nitride preferably has a thermal conductivity of no less than 40 W/m·K and no greater than 220 W/m·K, and more preferably no less than 50 W/m·K and no greater than 200 W/m·K. The boron nitride having a thermal conductivity of no less than 40 W/m·K and no greater than 220 W/m·K can improve the thermal conductivity of the toner particles and allow the toner particles to have both low-temperature fixability and high-temperature preservability.

The boron nitride is preferably contained in an amount of no less than 0.05% by mass and no greater than 35% by mass relative to the total mass of the toner cores, and more preferably in an amount of no less than 0.1% by mass and no greater than 30% by mass. The boron nitride contained in an amount of no less than 0.05% by mass and no greater than 35% by mass relative to the total mass of the toner cores can improve the thermal conductivity of the resulting toner and allow the toner to quickly melt from a small amount of heat. As a result, toner particles can have both low-temperature fixability and high-temperature preservability.

If the boron nitride has a too high thermal conductivity, for example, the high-temperature preservability of the resulting toner may be reduced. If the boron nitride has a too low thermal conductivity, the minimum fixable temperature of the resulting toner may be increased.

If the boron nitride content in the toner core is too low, the minimum fixable temperature of the resulting toner may be increased. If the boron nitride content in the toner core is too high, the toner cores are less meltable and therefore the minimum fixable temperature of the resulting toner may be increased.

Preferably, the toner cores are negatively chargeable and the shell layers are positively chargeable. The boron nitride contained in the toner cores is negatively chargeable, and therefore the toner cores are entirely negatively chargeable. As a result, the surface of the toner cores can attract positively chargeable material of the shell layers in forming the shell layers. More specifically, in an aqueous medium in which the material of the toner cores is negatively charged and the material of the shell layers is positively charged, one of the material of the toner cores and the material of the shell layers is electrically attracted toward the other, and the shell layers are formed on the surface of the toner cores through, for example, in-situ polymerization. Thus, it is possible to readily form uniform shell layers on the surface of the toner cores without the need of dispersing the toner cores in the aqueous medium using a dispersant.

In the present embodiment, the zeta potential of the toner cores having a negative polarity when measured in an aqueous medium adjusted to pH 4 is used as an indicator of that the toner cores are negatively charged. In order that the toner cores and the shell layers bond more strongly to one another, the toner cores preferably have a zeta potential at pH 4 of less than 0 V and the toner particles preferably have a zeta potential at pH 4 of greater than 0 V. In the present embodiment, a pH of 4 corresponds to the pH of the aqueous medium during formation of the shell layers.

Examples of methods for measuring the zeta potential include an electrophoresis method, an ultrasound method, and an electric sonic amplitude (ESA) method.

The electrophoresis method involves applying an electrical field to a liquid dispersion of particles, thereby causing electrophoresis of electrically charged particles in the dispersion, and measuring the zeta potential based on the rate of electrophoresis. An example of the electrophoresis method is laser Doppler electrophoresis in which migrating particles are irradiated with laser light and the rate of electrophoresis of the particles is calculated from an amount of Doppler shift of scattered light that is obtained. Advantages of laser Doppler electrophoresis are a lack of necessity for particle concentration in the dispersion to be high, a low number of parameters being necessary for calculating the zeta potential, and a good degree of sensitivity in detection of the rate of electrophoresis.

The ultrasound method involves irradiating a liquid dispersion of particles with ultrasound, thereby causing vibration of electrically charged particles in the dispersion, and measuring the zeta potential based on an electric potential difference that arises due to the vibration.

The ESA method involves applying a high frequency voltage to a liquid dispersion of particles, thereby causing electrically charged particles in the dispersion to vibrate and generate ultrasound. The zeta potential is then measured based on the magnitude (intensity) of the ultrasound.

An advantage of the ultrasound method and the ESA method is that the zeta potential can be measured to a good degree of sensitivity even when particle concentration of the dispersion is high (for example, exceeding 20% by mass).

Preferably, the toner cores contain a binder resin. The shell layers are formed such as to coat the surface of the toner cores. Preferably, the shell layers are formed from a positively chargeable resin.

The toner cores may contain a binder resin. Preferably, the toner cores are negatively chargeable. The binder resin for example has an ester group, a hydroxyl group, a carboxyl group, an amino group, an ether group, an acid group, or a methyl group as a functional group. The binder resin preferably has at least one functional group selected from the group consisting of a hydroxyl group, a carboxyl group, or an amino group in molecules thereof, and more preferably has either or both of a hydroxyl group and a carboxyl group in molecules thereof. This is because such functional groups can react to form a chemical bond with a resin component that is contained in the shell layers. As a result, toner cores containing a binder resin having such a functional group become strongly bound to the shell layers.

In order for a binder resin having a carboxyl group to be negatively chargeable, the binder resin preferably has an acid value of no less than 3 mg KOH/g and no greater than 50 mg KOH/g, and more preferably no less than 10 mg KOH/g and no greater than 40 mg KOH/g.

In order for a binder resin having a hydroxyl group to be negatively chargeable, the binder resin preferably has a hydroxyl value of no less than 10 mg KOH/g and no greater than 70 mg KOH/g, and more preferably no less than 15 mg KOH/g and no greater than 50 mg KOH/g.

The binder resin preferably has a solubility parameter (SP value) of no less than 10, and more preferably no less than 15. The SP value referred to in the present embodiment is a value calculated as a square root of molecular cohesive energy. The SP value can be calculated using a method described in R. F. Fedors, Polymer Engineering Science, 14, p 147 (1974). The unit of the SP value is $(MPa)^{1/2}$. The SP value referred to in the present embodiment is a value at 25° C.

Specific examples of the binder resin include thermoplastic resins (for example, styrene resins, acrylic resins, styrene-acrylic acid-based resins, polyethylene resins, polypropylene resins, vinyl chloride resins, polyester resins, polyamide resins, urethane resins, polyvinyl alcohol resins, vinyl ether resins, N-vinyl resins, and styrene-butadiene resins. The binder resin preferably includes either or both of a styrene-acrylic acid-based resin and a polyester resin in order to improve dispersibility of the colorant in the toner, chargeability of the toner, and fixability of the toner on a recording medium.

The styrene-acrylic acid-based resin is a copolymer of a styrene-based monomer and an acrylic acid-based monomer. Specific examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Specific examples of the acrylic acid-based monomer include (meth)acrylic acid, alkyl esters of (meth)acrylic acid (for example, methyl (meth)acrylate, ethyl (meth)acrylate, n-propyl (meth)acrylate, iso-propyl (meth)acrylate, n-butyl (meth)acrylate, 2-ethylhexyl (meth)acrylate, or iso-butyl (meth)acrylate), and hydroxyalkyl esters of (meth)acrylic acid (for example, 2-hydroxyethyl (meth)acrylate, 3-hydroxypropyl (meth)acrylate, 2-hydroxypropyl (meth)acrylate, or 4-hydroxybutyl (meth)acrylate).

A hydroxyl group can be introduced into the styrene-acrylic acid-based resin by using a monomer having a hydroxyl group (for example, p-hydroxystyrene, m-hydroxystyrene, or a hydroxyalkyl (meth)acrylate) during preparation of the styrene-acrylic acid-based resin. The hydroxyl value of the styrene-acrylic acid-based resin can be adjusted through appropriate adjustment of the amount of the monomer having the hydroxyl group.

A carboxyl group can be introduced into the styrene-acrylic acid-based resin by using acrylic acid as a monomer during preparation of the styrene-acrylic acid-based resin. The acid value of the styrene-acrylic acid-based resin can be adjusted through appropriate adjustment of the amount of the acrylic acid monomer.

The polyester resin can be prepared through condensation polymerization or condensation copolymerization of a di-, tri-, or higher-hydric alcohol with a di-, tri-, or higher-basic carboxylic acid.

Examples of di-hydric alcohols include diols (for example, ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol) and bisphenols (for example, bisphenol A, hydrogenated bisphenol A, polyoxyethylene bisphenol A ether, and polyoxypropylene bisphenol A ether).

Examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of di-basic carboxylic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acids (for example, n-butylsuccinic acid, isobutylsuccinic acid, n-octylsuccinic acid, n-dodecylsuccinic acid, and isododecylsuccinic acid), and alkenyl succinic acids (for example, n-butenylsuccinic acid, isobutenylsuccinic acid, n-octenylsuccinic acid, n-dodecenylsuccinic acid, and isododecenylsuccinic acid).

Examples of tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid. Alternatively, an ester-forming derivative (acid halide, acid anhydride, or lower alkyl ester) of any of the di-, tri-, or higher-basic carboxylic acids listed above may be used. The term "lower alkyl" refers to an alkyl group having a 1 to 6 carbon atoms.

The acid value and the hydroxyl value of the polyester resin can be adjusted through appropriate adjustment of the amount of the di-, tri-, or higher-hydric alcohol and the amount of the di-, tri-, or higher-basic carboxylic acid used in preparation of the polyester resin. An increase in the molecular weight of the polyester resin tends to cause a decrease in the acid value and the hydroxyl value of the polyester resin.

The colorant can be a commonly known pigment or dye that matches a color of the toner particles. The following lists specific examples of preferable colorants. The amount of the colorant is preferably no less than 1 part by mass and no greater than 30 parts by mass relative to 100 parts by mass of the binder resin.

Carbon black can be used as a black colorant. A colorant that is adjusted to a black color using colorants such as a yellow colorant, a magenta colorant, and a cyan colorant described below can be used as a black colorant.

In a situation in which the toner is a color toner, the colorant contained in the toner cores may be a colorant such as a yellow colorant, a magenta colorant, or a cyan colorant.

Examples of yellow colorants include condensed azo compounds, isoindolinone compounds, anthraquinone compounds, azo metal complexes, methine compounds, and arylamide compounds. Specific examples thereof include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples thereof include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants include copper phthalocyanine compounds, anthraquinone compounds, and basic dye lake compounds. Specific examples thereof include C.I. Pigment Blue (1, 7, 15, 15:1, 15:2, 15:3, 15:4, 60, 62, and 66), Phthalocyanine Blue, C.I. Vat Blue, and C.I. Acid Blue.

The releasing agent is used in order to improve fixability and offset resistance of the toner. The amount of the releasing agent is preferably no less than 1 part by mass and no greater than 30 parts by mass relative to 100 parts by mass of the binder resin, and more preferably no less than 5 parts by mass and no greater than 20 parts by mass.

The releasing agent is preferably a wax. Examples of the wax include ester waxes, polyethylene waxes, polypropylene waxes, fluororesin-based waxes, Fischer-Tropsch waxes, paraffin waxes, and montan waxes. Of the listed releasing agents, ester waxes are particularly preferable. The ester wax can be a synthetic ester wax or a natural ester wax (carnauba wax or rice wax). Of the ester waxes, synthetic ester waxes are preferable, because through appropriate selection of a synthetic raw material for the releasing agent, the melting point ($MP_r$) of the releasing agent as measured by the differential scanning calorimeter can be readily adjusted to be within the later-described preferable range. The releasing agents listed above may be used in a combination of two or more releasing agents.

There is no particular limitation on a method for manufacturing the synthetic ester wax, so long as the method is a chemical synthesis. For example, the synthetic ester wax can be synthesized using a commonly known method such as reaction of an alcohol and a carboxylic acid, or an alcohol and a carboxylic acid halide, in the presence of an acid catalyst. The raw material for the synthetic ester wax may for example be a raw material derived from a natural material, such as a long-chain fatty acid manufactured from a natural oil or fat. Alternatively, the synthetic ester wax may be a synthetic ester wax that is commercially available as a synthetic product.

The releasing agent preferably has a melting point ($Mp_r$) of no less than 50° C. and no greater than 80° C. The melting point ($MP_r$) of the releasing agent is a temperature of a largest heat absorption peak on a DSC curve plotted using a differential scanning calorimeter. A toner containing a releasing agent having a $Mp_r$ of no less than 50° C. and no greater than 80° C. has excellent low-temperature fixability and can restrict occurrence of offset at high temperatures.

The toner cores or the shell layers may include a charge control agent in order to adjust the acid value of the binder resin in the toner cores or to adjust chargeability of the shell layers.

The toner cores may contain magnetic powder in the binder resin as necessary. A toner containing a magnetic powder in toner cores thereof is used as a magnetic one-component developer. Preferable examples of the magnetic powder include iron such as ferrite and magnetite, ferromagnetic metals such as cobalt and nickel, alloys containing either or both of iron and a ferromagnetic metal, compounds containing either or both of iron and a ferromagnetic metal, ferromagnetic alloys subjected to ferromagnetization such as thermal treatment, and chromium dioxide.

The magnetic powder preferably has a particle size of no less than 0.1 μm and no greater than 1.0 μm, and more preferably no less than 0.1 μm and no greater than 0.5 μm. A magnetic powder having a particle size falling within the range described above can readily be dispersed uniformly in the binder resin.

In a configuration in which the toner is used as a one-component developer, the amount of the magnetic powder is preferably no less than 35 parts by mass and no greater than 60 parts by mass relative to 100 parts by mass of the toner overall, and more preferably no less than 40 parts by mass and no greater than 60 parts by mass. In a situation in which the toner is used as a two-component developer, the amount of the magnetic powder is preferably no greater than 20 parts by mass relative to 100 parts by mass of the toner overall, and more preferably no greater than 15 parts by mass.

A resin forming the shell layers is formed from a resin containing a positively chargeable component. The boron nitride that is contained in the toner cores is a negatively chargeable material. However, the positively chargeable component that is contained in the shell layers allows the boron nitride to be used for the positively chargeable toner. The positively chargeable component is preferably water-dispersible.

Examples of the positively chargeable component include an amino resin having an amino group. Specific examples of the positively chargeable component include melamine resins, guanamine resins (for example, benzoguanamine, acetoguanamine, and spiroguanamine), sulfonamide resins, urea resins, glyoxal resins, aniline resins, polyimide resins (for example, maleimide-based polymers, bismaleimide, amino-bismaleimide, and bismaleimide-triazine), derivatives of the aforementioned resins; and monomers or prepolymers for forming any one of the aforementioned resins and the derivatives thereof. The positively chargeable component is preferably a monomer or prepolymer for forming at least one resin selected from the group consisting of melamine resins, urea resins, glyoxal, and derivatives of the aforementioned resins.

A melamine resin is a polycondensate of melamine and formaldehyde. That is, melamine is a monomer for forming the melamine resin. A urea resin is a polycondensate of urea and formaldehyde. That is, urea is a monomer for forming the urea resin. A glyoxal resin is a polycondensate of formaldehyde and a reaction product of glyoxal and urea. That is, the reaction product of glyoxal and urea is a monomer for forming the glyoxal resin. The melamine for forming the melamine resin, the urea for forming the urea resin, and the urea for reaction with glyoxal in forming of the glyoxal resin may each be modified in a known manner. The monomer of a resin that is used for formation of the positively chargeable component may be methylolated with formaldehyde before formation of the shell layers, and thus may be used as a derivative.

The positively chargeable component preferably constitutes no less than 50% by mass of the resin forming the shell layers, more preferably no less than 80% by mass, and still more preferably 100% by mass of the resin forming the shell layers. When the positively chargeable component constitutes no less than 50% by mass of the resin forming the shell layers, the resulting toner can favorably achieve desired positive chargeability.

The resin forming the shell layers may contain a thermosetting component and a thermoplastic component other than the above-mentioned positively chargeable component. The resin forming the shell layers may contain a resin in which the thermoplastic component is cross-linked by the thermosetting component. The shell layers containing such resins have both suitable flexibility due to the thermoplastic component and suitable mechanical strength due to the three-dimensional cross-linking structure formed by thermosetting component. A toner including toner particles having such shell layers therefore is excellent in high-temperature preservability and low-temperature fixability. More specifically, the shell layers are not readily ruptured during storage or transport of the toner. On the other hand, during fixing of the toner, the shell layers are readily ruptured due to application of heat and pressure, and softening or melting of the toner cores proceeds rapidly. Accordingly, the toner can be fixed to a recording medium at low temperatures.

It should be noted that the thermoplastic component may be a component that is modified, for example by introduction of a functional group, oxidation, reduction, or substitution of atoms, without drastically changing the structure or properties of the base thermoplastic resin. It should be also noted that the thermosetting component may be a component that is modified, for example by introduction of a functional group, oxidation, reduction, or substitution of atoms, without drastically changing the structure or properties of the base monomer or prepolymer of the thermosetting resin.

The thermoplastic resin preferably has a functional group that is reactive with a functional group of a monomer of the thermosetting resin. For example, the thermoplastic resin preferably has an activated hydrogen-containing functional group such as a hydroxyl group, a carboxyl group, or an amino group. The amino group may be present in the thermoplastic resin in the form of a carbamoyl group ($—CONH_2$). In terms of allowing simple formation of the shell layers, preferable examples of the thermoplastic resin include a thermoplastic resin containing a unit derived from (meth)acrylamide; and a thermoplastic resin having a functional group such as a carbodiimide group, an oxazoline group, or a glycidyl group.

Examples of the thermoplastic resin include acrylic acid-based resins, styrene-acrylic acid-based copolymer resins, silicone-(meth)acrylic graft copolymers, urethane resins, polyester resins, polyvinyl alcohols, and ethylene vinyl alcohol copolymers. These resins may contain a unit derived from a monomer having a functional group such as a carbodiimide group, an oxazoline group, or a glycidyl group. In particular, the thermoplastic resin is preferably an acrylic acid-based resin, a styrene-acrylic acid-based copolymer, or a silicone-(meth)acrylic graft copolymer, with an acrylic acid-based resin being particularly preferable.

Examples of acrylic acid-based monomers that can be used in preparation of the acrylic acid-based resin include: (meth)acrylic acid; alkyl (meth)acrylates (for example, methyl (meth)acrylate, ethyl (meth)acrylate, n-propyl (meth)acrylate, and n-butyl (meth)acrylate); aryl (meth) acrylates (for example, phenyl (meth)acrylate); hydroxyalkyl (meth)acrylates (for example, 2-hydroxyethyl (meth) acrylate, 3-hydroxypropyl (meth)acrylate, 2-hydroxypropyl (meth)acrylate, and 4-hydroxybutyl (meth)acrylate); (meth) acrylamide; ethylene oxide adduct of (meth)acrylic acid; and alkyl ethers (for example, methyl ether, ethyl ether, n-propyl ether, and n-butyl ether, of ethylene oxide adducts of (meth) acrylic acid esters.

Preferably, the shell layers are formed in an aqueous medium, which is less prone to dissolution of the binder resin and elution of the releasing agent contained in the toner cores. It is therefore preferable that the thermoplastic resin that is used for formation of the shell layers is water-soluble, and it is particularly preferable that the thermoplastic resin is used in the form of an aqueous solution.

The shell layers preferably have a thickness of no less than 0.1 nm and no greater than 200 nm, and more preferably no less than 1 nm and no greater than 100 nm. Shell layers having a too large thickness may not rupture upon pressure being applied during fixing of the toner to a recording medium. In such a situation, softening or melting of the binder resin or the releasing agent contained in the toner cores may not progress smoothly, making it difficult to fix the toner to the recording medium at low temperatures. Shell layers having a too small thickness have poor strength and may rupture due to an impact occurring, for example, during transport of the toner. When a toner is stored at high temperatures, toner particles having at least partially ruptured shell layers are likely to aggregate. The aggregation occurs due to components of the toner particles, such as the releasing agent, exuding to the surface of the toner particles through the ruptured parts of the shell layers at high temperatures.

Thickness of a shell layer can be measured by analyzing a transmission electron microscopy (TEM) image of a cross-section of a toner particle using commercially available image-analyzing software. Examples of the commercially available image-analyzing software include WinROOF (product of Mitani Corporation). More specifically, on the cross-section of a toner particle, two straight lines are drawn to intersect at right angles at approximately the center of the cross-section. Lengths of segments of the two lines crossing the shell layer are measured at four locations. An average value of the lengths measured at the four locations is determined to be the thickness of the shell layer of the toner particle which is a measurement target. In this way, shell layer thickness is measured for at least ten toner particles and an average value of thicknesses of the respective shell layers of the measurement target toner particles is calculated. The calculated average value is determined to be the thickness of the shell layers of the toner particles.

When the shell layer is excessively thin, the TEM image may not clearly depict a boundary between the shell layer and the toner core, complicating measurement of thickness of the shell layer. In such a situation, in order that thickness of the shell layer can be measured, TEM imaging may be used in combination with energy dispersive X-ray spectroscopic analysis (EDX) to clarify the boundary between the shell layer and the toner core. The boundary is clarified through mapping of a characteristic element (for example, nitrogen) in a material of the shell layer in the TEM image.

An external additive may be caused to adhere to the surface of the toner mother particles as necessary. Examples of the external additive include fine particles of silica or a metal oxide (for example, alumina, titanium oxide, magnesium oxide, zinc oxide, strontium titanate, and barium titanate).

The external additive preferably has a particle size of no less than 0.01 μm and no greater than 1.0 μm. The amount of the external additive is preferably no less than 1 part by mass and no greater than 10 parts by mass relative to 100 parts by mass of the toner mother particles, and more preferably no less than 2 parts by mass and no greater than 5 parts by mass.

The toner of the present embodiment may be mixed with a desired carrier and used as a two-component developer. In a situation in which the two-component developer is manufactured, preferably a magnetic carrier is used.

Preferable examples of the carrier include a carrier whose particles have resin-coated carrier cores. Specific examples of the carrier cores include: particles of iron, oxidized iron, reduced iron, magnetite, copper, silicon steel, ferrite, nickel, or cobalt; particles of alloys of one or more of these materials and a metal, such as manganese, zinc, or aluminum; particles of iron-nickel alloys or iron-cobalt alloys; particles of ceramics (titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate); and particles of high-dielectric substances (ammonium dihydrogen phosphate, potassium dihydrogen phosphate, or Rochelle salt). The carrier may also be a resin carrier having any of the above listed particles dispersed therein.

Examples of the resin that coats the carrier cores include acrylic acid-based copolymers, styrene-based copolymers, styrene-acrylic acid-based copolymers, olefin-based copolymers (polyethylene, chlorinated polyethylene, and polypropylene), vinyl chloride, polyvinyl acetates, polycarbonate resins, cellulose resins, polyester resins, unsaturated polyester resins, polyamide resins, urethane resins, epoxy resins, silicone resins, fluororesins (polytetrafluoroethylene, polychlorotrifluoroethylene, and polyvinylidene fluoride), phenolic resins, xylene resins, diallyl phthalate resins, polyacetal resin, and amino resins. The resins listed above may be used in a combination of two or more resins.

Particle size of the carrier is measured using an electron microscope. The carrier preferably has a particle size of no less than 20 μm and no greater than 120 μm, and more preferably no less than 25 μm and no greater than 80 μm.

In a configuration in which the toner is used in a two-component developer, the toner preferably constitutes no less than 3% by mass and no greater than 20% by mass of the two-component developer, and more preferably no less than 5% by mass and no greater than 15% by mass of the two-component developer.

[Toner Manufacturing Method]

No particular limitation is placed on the toner manufacturing method so long as toner cores can be coated by shell layers formed from the above-specified materials. Hereinafter, a preferable method for manufacturing the electrostatic latent image developing toner of the present embodiment will be described. The manufacturing method includes preparing toner cores (toner core preparation) and forming shell layers on the surface of the toner cores (shell layer formation).

No particular limitation is placed on the toner core preparation and a known method can be employed as appropriate so long as optional components (a colorant, a charge control agent, a releasing agent, or a magnetic powder) can be well dispersed in a binder resin. Examples of methods that can be employed for the toner core preparation include a pulverization method and an aggregation method.

In the pulverization method, the boron nitride and the binder resin, and the optional components (for example, the colorant, the releasing agent, the charge control agent, or the magnetic powder) are mixed (mixing), a resulting mixture is melt-knead (kneading), a resulting kneaded product is pulverized (pulverization), and a resulting pulverized product is classified (classification) to give toner cores having a desired particle size. The toner cores are prepared relatively easily by the pulverization method. On the other hand, a disadvantage of the pulverization method compared to the aggregation method is that as a result of the toner cores being obtained through a pulverization process, it is difficult to obtain the toner cores with high sphericity. However, during the shell layer formation to be explained further below, the toner cores become relatively soft and contract due to surface tension before the shell layers are formed thereon. The aforementioned softening and contraction of the toner cores causes spheroidizing of the toner cores. For manufacturing the toner of the present embodiment, therefore, it is not a major disadvantage that the toner cores have a somewhat low sphericity.

The aggregation process includes aggregation and coalescence. The aggregation involves causing fine particles of components for forming the toner cores to aggregate in an aqueous medium to give aggregated particles. The coalescence involves causing the components in the aggregated particles to coalesce in the aqueous medium to give toner cores. Toner cores prepared by the aggregation method are likely to have a uniform shape and a uniform particle size.

The toner cores preferably have a negative triboelectric charge, and more preferably a triboelectric charge of no greater than −10 μC/g. The triboelectric charge is measured as described below. A standard carrier ("N-01", a standard carrier for use with negatively chargeable toner) provided by The Imaging Society of Japan and the toner cores are mixed for 30 minutes using a TURBULA (registered Japanese trademark) Mixer. The amount of the toner cores used during the above is determined such that the toner cores have a concentration of 7% by mass relative to mass of the standard carrier. After mixing, the triboelectric charge of the toner cores is measured by a Q/m meter ("Model 210HS-2A", product of TREK, Inc.). The triboelectric charge of the toner cores measured as described above indicates tendency of the toner cores to be charged and whether such charging tends to be to positive or negative polarity.

The toner cores preferably have a negative zeta potential, and more preferably a zeta potential of no greater than −10 mV when measured in an aqueous medium adjusted to pH 4. The zeta potential is measured in a dispersion at pH 4 as described below. That is, 0.2 g of toner cores, 80 mL of ion exchanged water, and 20 g of non-ionic surfactant ("polyvinylpyrrolidone K-85", product of Nippon Shokubai Co., Ltd., concentration: 1% by mass) are mixed using a magnetic stirrer to uniformly disperse the toner cores in a solvent to give a dispersion. Next, the dispersion is adjusted to pH 4 through addition of dilute hydrochloric acid. Using the dispersion as a measurement sample, the zeta potential of the toner cores in the dispersion is measured using a zeta potential and particle distribution measuring apparatus ("Delsa Nano HC", product of Beckman Coulter, Inc.).

In order to form uniform shell layers on the surface of the toner cores, it is normally necessary for the toner cores to be sufficiently dispersed in an aqueous medium including a dispersant. However, when the triboelectric change of the toner cores with the standard carrier under the above-specified conditions is within a specific range, one of the toner cores, which are negatively charged, and the positively chargeable component forming the shell layers is electrically attracted toward the other in the aqueous medium. Then, reaction of the components such as the positively chargeable component adhering to the toner cores proceeds favorably at the surface of the toner cores. As a consequence, uniform shell layers can be formed without using a dispersant. According to the configuration in which a dispersant, which has high effluent load, is not used, the total organic carbon concentration of effluent discharged during manufacture of the toner particles can be restricted to a low level of no greater than 15 mg/L without diluting the effluent.

The same effect can be achieved during formation of the shell layers on the surface of the toner cores in the aqueous medium when the zeta potential of the toner cores in the pH 4 aqueous medium is within a specific range.

In the shell layer formation, the shell layers are formed such as to coat the toner cores. Preferably, the shell layers are formed using a thermoplastic resin and melamine, urea, a reaction product of glyoxal and urea, or a precursor (methylol compound) generated through an addition reaction of formaldehyde and any of the above. Preferably, the shell layers are formed in an aqueous medium such as water, because it is necessary to prevent dissolution of the binder resin in the solvent used for the formation of the shell layers and elution of a component such as the releasing agent contained in the toner cores.

Preferably, the shell layers are formed by adding the materials for forming the shell layers to the aqueous dispersion containing the toner cores. Examples of methods for causing the toner cores to be well dispersed in the aqueous medium include a method involving mechanically dispersing the toner cores in an aqueous medium using an apparatus capable of vigorously stirring the dispersion (for example, "HIVIS MIX", product of PRIMIX Corporation) and a method involving dispersing the toner cores in an aqueous medium containing a dispersant.

The aqueous dispersion is preferably adjusted to a pH of approximately 4 using an acidic substance prior to addition of the materials for forming the shell layers. Adjustment of the dispersion to an acidic pH promotes a polycondensation reaction of the materials for forming the shell layers to be described later.

After the pH of the aqueous dispersion is adjusted as necessary, the materials for forming the shell layers and the toner cores are mixed in an aqueous medium. Next, a reaction between the materials for forming the shell layers is promoted at the surface of the toner cores in the aqueous dispersion, thereby forming the shell layers such as to coat the surface of the toner cores.

During the formation of the shell layers on the surface of the toner cores, the temperature is preferably no less than 40° C. and no greater than 95° C., and more preferably no less than 50° C. and no greater than 80° C. in order that the formation of the shell layers proceeds favorably.

Once the shell layers have been formed as described above, a dispersion of toner particles (toner mother particles)

is obtained by cooling the aqueous dispersion containing the toner cores coated by the shell layers to room temperature. The toner is subsequently collected from the dispersion of the toner mother particles by performing, as necessary, one or more processes selected from among a process of washing the toner mother particles (washing process), a process of drying the toner mother particles (drying process), and a process of causing an external additive to adhere to the surface of the toner mother particles (external addition process).

In the washing process, the toner particles (toner mother particles) are washed with water. Preferable examples of methods for washing the toner particles include: a method involving collecting a wet cake of the toner particles through solid-liquid separation from the aqueous dispersion containing the toner particles, followed by washing the wet cake with water; and a method involving precipitating the toner particles in the dispersion containing the toner particles, substituting the supernatant with water, and then re-dispersing the toner particles in water.

In the drying process, the toner particles (toner mother particles) are dried. Preferable examples of methods for drying the toner particles include a method involving using a dryer (for example, a spray dryer, a fluidized bed dryer, a vacuum freeze dryer, or a reduced pressure dryer). In particular, the spray dryer is preferably used in order to inhibit aggregation of the toner particles during drying. Use of a spray dryer allows a liquid dispersion of an external additive such as silica to be sprayed with the dispersion of the toner particles and thus causes the external additive to adhere to the surface of the toner particles.

In the external additive addition process, the external additive is caused to adhere to the surface of the toner particles (toner mother particles). Preferable examples of methods for causing the external additive to adhere to the toner particles include a method involving mixing the toner particles and the external additive using a mixer (for example, an FM mixer or a Nauta mixer (registered Japanese trademark)) under conditions set such that the external additive does not become embedded in the surface of the toner particles.

The positively chargeable toner for electrostatic latent image development of the present disclosure described above can achieve both low-temperature fixability and high-temperature preservability and further have desired positive chargeability. The positively chargeable toner for electrostatic latent image development of the present disclosure can therefore be favorably used in various image forming apparatuses.

EXAMPLES

Example 1

Toner Core Preparation

First, 60 parts by mass of a polyester resin ("CBC500", product of Kao Corporation) as a binder resin, 5 parts by mass of a colorant ("ECR-101", product of Dainichiseika Color & Chemicals Mfg. Co., Ltd.), 5 parts by mass of carnauba wax ("Special Refined Carnauba Wax (Tokusei) No. 1", product of S. Kato & Co.), and 30 parts by mass of boron nitride ("ZN-2", product of Maruka Corporation., Ltd.) were put in an FM mixer ("FM-20B", product of Nippon Coke & Engineering Co., Ltd.) and mixed at 2400 rpm for 180 seconds. Next, a resulting mixture was melt-kneaded using a two-axis extruder ("PCM-30", product of Ikegai Corp.) at a material feeding speed of 5 kg/hour, a shaft rotation speed of 150 rpm, and a cylinder temperature of 150° C. A resulting kneaded product was subsequently cooled. The kneaded product was roughly pulverized using a mill ("Rotoplex (registered Japanese trademark) 8/16", product of Hosokawa Micron Corporation) and then finely pulverized using an impact plate pulverizer ("Dispersion Separator", product of Nippon Pneumatic Mfg.). Next, a resulting pulverized product was classified using a classifier ("Elbow Jet EJ-LABO", product of Nittetsu Mining Co., Ltd.) to give toner cores having a mass average particle diameter of 6.0 μm.

Shell Layer Formation

First, 300 mL of ion exchanged water was added to a 1 L three-necked flask having a thermometer and a stirring impeller, and subsequently the internal temperature of the flask was maintained at 30° C. using a water bath. Next, dilute hydrochloric acid was added to the flask to adjust the pH of the aqueous medium in the flask to 4. After the pH adjustment, 35 mL of an aqueous solution of hexamethylol melamine prepolymer (MIRBANE (registered Japanese trademark) resin SM-607, product of Showa Denko K.K., solid concentration: 80% by mass) was added to the flask as a material of the shell layers. Next, the contents of the flask were stirred to dissolve the raw materials of the shell layers in the aqueous medium, thereby acquiring an aqueous solution (A) of the raw materials of the shell layers.

Next, 300 g of the toner cores were added to the aqueous solution (A) and the contents of the flask were stirred at 200 rpm for 1 hour. Next, 300 mL of ion exchanged water was added to the flask. Thereafter, the internal temperature of the flask was increased to 70° C. at a rate of 1° C./minute while stirring the contents of the flask at 100 rpm. Once the internal temperature reached 70° C., the contents of the flask were stirred at 100 rpm for another two hours at the same temperature. Next, the pH of the contents of the flask was adjusted to 7 through addition of sodium hydroxide. Next, the contents of the flask were cooled to room temperature to obtain a dispersion including toner mother particles.

Washing Process

A wet cake of the toner mother particles was collected by filtering the dispersion including the toner mother particles using a Buchner funnel. The toner mother particles were washed by re-dispersing the wet cake of the toner mother particles in ion exchanged water. Washing of the toner mother particles using ion exchanged water was repeated five times in the same manner.

Drying Process

The wet cake of the toner mother particles was dispersed in an aqueous ethanol solution of a concentration of 50% by mass to obtain a slurry. The toner mother particles in the slurry were dried using a continuous type surface modifier ("COATMIZER (registered Japanese trademark)", product of Freund Corporation) to obtain the toner mother particles. The COATMIZER (registered Japanese trademark) was used for drying at a hot-blast temperature of 45° C. and a flow rate of 2 $m^3$/minute.

External Addition Process

Using an FM mixer (product of Nippon Coke & Engineering Co., Ltd.), 100 parts by mass of the toner mother particles obtained from the drying process and 0.5 parts by mass of dry silica fine particles ("AEROSIL (registered Japanese trademark) REA90", product of Nippon Aerosil Co., Ltd.) were mixed for 5 minutes to cause the external additive to adhere to the toner mother particles. Thereafter, a 200-mesh sieve (opening: 75 μm) was used to sift toner particles to obtain a toner of Example 1.

Example 2

A toner of Example 2 was prepared in the same manner as in Example 1 except that the amount of the boron nitride was changed from 30 parts by mass to 0.1 parts by mass, and the amount of the binder resin was changed from 60 parts by mass to 89.9 parts by mass.

Example 3

A toner of Example 3 was prepared in the same manner as in Example 1 except that the boron nitride was changed from ZN-2 to ZN-20S (product of Maruka Corporation., Ltd.).

Example 4

A toner of Example 4 was prepared in the same manner as in Example 2 except that the boron nitride was changed from ZN-2 to ZN-20S (product of Maruka Corporation., Ltd.).

Example 5

A toner of Example 5 was prepared in the same manner as in Example 3 except that the amount of the aqueous solution of hexamethylol melamine prepolymer was changed from 35 mL to 0.7 mL.

Example 6

A toner of Example 6 was prepared in the same manner as in Example 3 except that the aqueous solution of hexamethylol melamine prepolymer was changed to an aqueous solution of a methylated urea resin ("NIKALAC (registered Japanese trademark) MX-280", Sanwa Chemical, co., LTD., solid concentration: 95% by mass)".

Example 7

First, 60 parts by mass of a polyester resin ("CBC500", product of Kao Corporation) as a binder resin, 5 parts by mass of a colorant ("ECR-101", product of Dainichiseika Color & Chemicals Mfg. Co., Ltd.), and 5 parts by mass of carnauba wax ("Special Refined Carnauba Wax (Tokusei) No. 1", product of S. Kato & Co.) were put in an FM mixer ("FM-20B", product of Nippon Coke & Engineering Co., Ltd.) and mixed at 2400 rpm for 180 seconds. Next, a resulting mixture was melt-kneaded using a two-axis extruder ("PCM-30", product of Ikegai Corp.) at a material feeding speed of 5 kg/hour, a shaft rotation speed of 150 rpm, and a cylinder temperature of 150° C. A resulting melt-kneaded product was subsequently cooled. The kneaded product was roughly pulverized using a mill ("Rotoplex (registered Japanese trademark) 8/16", product of Hosokawa Micron Corporation) and then finely pulverized using an impact plate pulverizer ("Dispersion Separator", product of Nippon Pneumatic Mfg.). Next, a resulting pulverized product was classified using a classifier ("Elbow Jet EJ-LABO", product of Nittetsu Mining Co., Ltd.). Next, 955 g of the classified product and 5 g of boron nitride ("ZN-20S", product of Maruka Corporation., Ltd.) were put in an FM mixer ("FM-20B", product of Nippon Coke & Engineering Co., Ltd.) and mixed at 2400 rpm for 300 seconds to obtain toner cores having boron nitride particles externally added to the surface thereof and having a mass average particle diameter of 6.0 μm. The toner cores were subjected to the same shell layer formation as in Example 1 to prepare a toner of Example 7.

Example 8

A toner of Example 8 was prepared in the same manner as in Example 2 except that the amount of the aqueous solution of hexamethylol melamine prepolymer was changed from 35 mL to 60 mL.

Example 9

A toner of Example 9 was prepared in the same manner as in Example 3 except that the amount of the aqueous solution of hexamethylol melamine prepolymer was changed from 35 mL to 0.3 mL.

Comparative Example 1

A toner of Comparative Example 1 was prepared in the same manner as in Example 1 except that the boron nitride was changed from ZN-2 to ZN-10 (product of Maruka Corporation., Ltd.).

Comparative Example 2

A toner of Comparative Example 2 was prepared in the same manner as in Example 2 except that the boron nitride was changed from ZN-2 to ZN-10 (product of Maruka Corporation., Ltd.).

Comparative Example 3

A toner of Comparative Example 3 was prepared in the same manner as in Example 1 except that the amount of the boron nitride was changed from 30 parts by mass to 40 parts by mass, and the amount of the binder resin was changed from 60 parts by mass to 50 parts by mass.

Comparative Example 4

A toner of Comparative Example 4 was prepared in the same manner as in Example 1 except that the amount of the boron nitride was changed from 30 parts by mass to 0.01 parts by mass, and the amount of the binder resin was changed from 60 parts by mass to 89.99 parts by mass.

Comparative Example 5

A toner of Comparative Example 5 was prepared in the same manner as in Comparative Example 3 except that the boron nitride was changed from ZN-2 to ZN-20S (product of Maruka Corporation., Ltd.).

Comparative Example 6

A toner of Comparative Example 6 was prepared in the same manner as in Comparative Example 4 except that the boron nitride was changed from ZN-2 to ZN-20S (product of Maruka Corporation., Ltd.).

Comparative Example 7

A toner of Comparative Example 7 was prepared in the same manner as in Example 1 except that the boron nitride was changed from ZN-2 to AN-101 (product of Maruka Corporation., Ltd.).

Comparative Example 8

A toner of Comparative Example 8 was prepared in the same manner as in Example 2 except that the boron nitride was changed from ZN-2 to AN-101 (product of Maruka Corporation., Ltd.).

The toners obtained in Examples 1 to 9 and Comparative Examples 1 to 8 were measured and evaluated as described below.

<Method of Determining Thickness of Shell Layer>

For determining the thickness of a shell layer forming the surface of a toner, a cross-section of layers of the toner was used to measure the thickness of the shell layer constituting an outermost of the layers. A toner which had been encapsulated and on which dry silica had been distributed was sufficiently dispersed in a cold-setting epoxy resin and left to harden at an ambient temperature of 40° C. for 2 days. A resulting hardened material was dyed in osmium tetroxide and subsequently a flake sample was cut out therefrom using a microtome equipped with a diamond knife. The thickness of each shell layer in the cut out toner sample was measured by observing the layered cross-section of the sample toner using a transmission electron microscope (TEM). A shell layer having a thickness of less than 5 nm was indistinguishable in the observation using the TEM. The thickness of such a shell layer was determined by performing elemental mapping of nitrogen using an electron energy loss spectrometer in addition to the TEM (TEM-EELS).

<Method of Measuring Thermal Conductivity>

The thermal conductivity of each toner and the boron nitride therein was measured by the laser flash method using a thermal conductivity measuring device ("TC7000", product of ADVANCE RIKO, Inc.). A disk-shaped test piece having a diameter of 10 mm and a thickness of 2 mm was used as a sample, and the measurement was performed at a temperature adjusted to 25° C. The thermal conductivity of each toner was measured according to the "Test method for thermal resistance and related properties of thermal insulations—heat flow meter (HFM) apparatus" described in JIS A 1412-2.

Preparation of Two-Component Developer

Minimum fixable temperature, hot offset temperature, passage ratio representing blocking resistance, and image density of each toner were evaluated using a two-component developer prepared according to the method described below.

A developer carrier (carrier for TASKalfa 5550ci, product of KYOCERA Document Solutions Inc.) and a toner in an amount of 10% by mass relative to the mass of the carrier were mixed for 30 minutes using a ball mill to prepare an evaluation two-component developer.

<Minimum Fixable Temperature>

A roller-roller type heat pressure fixing unit (FS-C5250DN, product of KYOCERA Document Solutions Inc.) was used as an evaluation device. The minimum fixable temperature was determined by varying the fixing temperature from 100° C. to 200° C. under conditions of a speed of 200 mm/s and a nip interval of 8 mm. The transit time of paper through a nip of the fixing unit was 40 ms. A 1.0 mg/cm$^2$ toner image was formed on 90 g/m$^2$ paper using a toner, and then the paper was passed through the fixing unit adjusted to a certain fixing temperature. This process was performed for each fixing temperature to determine the minimum fixable temperature with respect to the toner. More specifically, the paper was folded at the image fixed thereon and a 1 kg weight was rubbed back and forth on the fold 10 times. A fixing temperature resulting in a length of toner peeling at the fold of less than 1 mm was determined to be the minimum fixable temperature. A minimum fixable temperature of no greater than 125° C. was evaluated as very good in low-temperature fixability. A minimum fixable temperature of greater than 125° C. and no greater than 130° C. was evaluated as good in low-temperature fixability. A minimum fixable temperature of greater than 130° C. was evaluated as poor in low-temperature fixability.

<Hot Offset Temperature>

A solid image was formed in an unfixed state on a recording medium using the same evaluation device and the same type of recording medium and under the same conditions as in the low-temperature fixability evaluation. A temperature at which toner remaining on a heat roller of the evaluation device was transferred to the recording medium during a second rotation of the heat roller was determined to be a hot offset occurrence temperature. A hot offset occurrence temperature of no less than 165° C. was evaluated as very good. A hot offset occurrence temperature of less than 165° C. and no less than 160° C. was evaluated as good. A hot offset occurrence temperature of less than 160° C. was evaluated as poor.

<Passage Ratio Representing Thermal Blocking Resistance>

A toner in an amount of 3 g was left to stand at 60° C. for 3 hours and subsequently sifted through a 200-mesh sieve set in a vibratory sieving machine for 30 seconds. Based on the amount of the toner remaining on the sieve, a rate of the toner that passed through the sieve was calculated as a passage ratio representing thermal blocking resistance. A passage ratio of no less than 85% by mass was evaluated as very good in thermal blocking resistance. A passage ratio of no less than 80% by mass and less than 85% by mass was evaluated as good in thermal blocking resistance. A passage ratio of less than 80% by mass was evaluated as poor in thermal blocking resistance.

<Image Density>

FS-C5250DN (product of KYOCERA Document Solutions Inc.) was used as an evaluation device. A two-component developer prepared as described above was put in a black-color developing unit in the evaluation device, and image density evaluation was performed at a temperature of 23° C. and a relative humidity of 50%. More specifically, 1000 successive sheets of a recording medium were printed on with a coverage of 4%, and subsequently a solid image was formed on a sheet of the recording medium with a coverage of 100%. Image density of the solid image was measured using a reflectance densitometer ("Spectro-EyeLT", product of SAKATA INX ENG. CO., LTD.). An image density of no less than 1.25 was evaluated as very good. An image density of no less than 1.20 and less than 1.25 was evaluated as good. An image density of less than 1.20 was evaluated as poor.

[Evaluation Results]

Tables 1 and 2 show measurement and evaluation results of each of the toners of Examples 1 to 9 and Comparative Examples 1 to 8.

TABLE 1

| | Boron nitride | | | | Shell layer | | | Thermal |
|---|---|---|---|---|---|---|---|---|
| | Type | Purity (% by mass) | Content in toner core (% by mass) | Thermal conductivity (W/(m · K)) | Type | Amount (mL) | Thick-ness (nm) | conductivity of toner (W/(m · K)) |
| Example 1 | ZN-2 | 90 | 30 | 50 | Hexamethylol melamine prepolymer | 35 | 100 | 0.16 |
| Example 2 | ZN-2 | 90 | 0.1 | 50 | Hexamethylol melamine prepolymer | 35 | 100 | 0.11 |
| Example 3 | ZN-20S | 98 | 30 | 200 | Hexamethylol melamine prepolymer | 35 | 100 | 0.17 |
| Example 4 | ZN-20S | 98 | 0.1 | 200 | Hexamethylol melamine prepolymer | 35 | 100 | 0.15 |
| Example 5 | ZN-20S | 98 | 30 | 200 | Hexamethylol melamine prepolymer | 0.7 | 1 | 0.19 |
| Example 6 | ZN-20S | 98 | 30 | 200 | Methylated urea resin | 35 | 100 | 0.18 |
| Example 7 | ZN-20S | 98 | 0.5 | 200 | Hexamethylol melamine prepolymer | 35 | 100 | 0.15 |
| Example 8 | ZN-2 | 90 | 0.1 | 50 | Hexamethylol melamine prepolymer | 60 | 150 | 0.10 |
| Example 9 | ZN-20S | 98 | 30 | 200 | Hexamethylol melamine prepolymer | 0.3 | 0.5 | 0.20 |
| Comparative Example 1 | ZN-10 | 85 | 30 | 20 | Hexamethylol melamine prepolymer | 35 | 100 | 0.13 |
| Comparative Example 2 | ZN-10 | 85 | 0.1 | 20 | Hexamethylol melamine prepolymer | 35 | 100 | 0.11 |
| Comparative Example 3 | ZN-2 | 90 | 40 | 50 | Hexamethylol melamine prepolymer | 35 | 100 | 0.16 |
| Comparative Example 4 | ZN-2 | 90 | 0.01 | 50 | Hexamethylol melamine prepolymer | 35 | 100 | 0.10 |
| Comparative Example 5 | ZN-20S | 98 | 40 | 200 | Hexamethylol melamine prepolymer | 35 | 100 | 0.19 |
| Comparative Example 6 | ZN-20S | 98 | 0.01 | 200 | Hexamethylol melamine prepolymer | 35 | 100 | 0.11 |
| Comparative Example 7 | AN-101 | 98 | 30 | 250 | Hexamethylol melamine prepolymer | 35 | 100 | 0.18 |
| Comparative Example 8 | AN-101 | 98 | 0.1 | 250 | Hexamethylol melamine prepolymer | 35 | 100 | 0.15 |

TABLE 2

| | Minimum fixable temperature (° C.) | Hot offset temperature (° C.) | Passage ratio representing thermal blocking resistance (% by mass) | Image density (I.D.) |
|---|---|---|---|---|
| Example 1 | 120 | 170 | 90 | 1.25 |
| Example 2 | 130 | 165 | 90 | 1.32 |
| Example 3 | 120 | 165 | 90 | 1.25 |
| Example 4 | 120 | 165 | 90 | 1.30 |
| Example 5 | 115 | 160 | 80 | 1.20 |
| Example 6 | 120 | 165 | 85 | 1.26 |
| Example 7 | 120 | 165 | 90 | 1.32 |
| Example 8 | 130 | 160 | 90 | 1.34 |
| Example 9 | 120 | 165 | 80 | 1.20 |
| Comparative Example 1 | 135 | 170 | 90 | 1.25 |
| Comparative Example 2 | 135 | 165 | 90 | 1.34 |
| Comparative Example 3 | 140 | 170 | 90 | 1.10 |
| Comparative Example 4 | 135 | 165 | 90 | 1.36 |
| Comparative Example 5 | 140 | 165 | 90 | 1.11 |
| Comparative Example 6 | 135 | 165 | 90 | 1.29 |
| Comparative Example 7 | 120 | 165 | 70 | 1.08 |
| Comparative Example 8 | 125 | 155 | 75 | 1.31 |

The toners of Examples 1 to 9 were excellent in low-temperature fixability, hot offset resistance, and thermal blocking resistance. On the other hand, the toners of Comparative Examples 1 to 6 were poor in low-temperature fixability, and the toners of Comparative Examples 7 and 8 were poor in thermal blocking resistance. The toner of Comparative Example 8 was poor also in hot offset resistance.

The images formed using the toners of Examples 1 to 9 maintained a good image density even after the 1000-consecutive-sheet printing with a coverage of 4%. On the other hand, the images formed using the toners of Comparative Examples 3, 5, and 7 had a reduced image density after the 1000-consecutive-sheet printing with a coverage of 4%.

What is claimed is:

1. A toner for electrostatic latent image development, comprising toner particles, the toner particles each including:

a toner core containing boron nitride; and a shell layer disposed over a surface of the toner core, wherein the toner core is negatively chargeable, the shell layer is positively chargeable, the toner is positively chargeable, the boron nitride is contained in an amount of no less than 0.05% by mass and no greater than 35% by mass relative to total mass of the toner core, the boron nitride has a thermal conductivity of no less than 40 W/m·K and no greater than 220 W/m·K, and the boron nitride is absent in a center region of the toner core and present in a surface region of the toner core.

2. The toner for electrostatic latent image development according to claim 1, wherein the toner particles have a thermal conductivity of no less than 0.10 W/m·K and no greater than 0.20 W/m·K.

3. The toner for electrostatic latent image development according to claim 1, wherein the shell layer has a thickness of no less than 0.5 nm and no greater than 150 nm.

4. The toner for electrostatic latent image development according to claim 1, wherein the shell layer contains a resin including a positively chargeable component, and the positively chargeable component includes a monomer or prepolymer for forming one or more resins selected from the group consisting of melamine resins and derivatives thereof, guanamine resins and derivatives thereof, sulfonamide resins, urea resins and derivatives thereof, glyoxal resins, aniline resins, and polyimide resins.

5. The toner for electrostatic latent image development according to claim 1, wherein the toner core further contains a polyester resin.

6. The toner for electrostatic latent image development according to claim 1, wherein the shell layer has homogenized components.

7. The toner for electrostatic latent image development according to claim 1, wherein the shell layer has a layer shape.

* * * * *